US011059555B2

(12) United States Patent
Ahlgren

(10) Patent No.: US 11,059,555 B2
(45) Date of Patent: Jul. 13, 2021

(54) TROLLING MOTOR LATCHING SYSTEM

(71) Applicant: Garmin Switzerland GmbH, Schaffhausen (CH)

(72) Inventor: Austin W. Ahlgren, Lenexa, KS (US)

(73) Assignee: Garmin Switzerland GmbH

( * ) Notice: Subject to any disclaimer, the term of this patent is extended or adjusted under 35 U.S.C. 154(b) by 0 days.

(21) Appl. No.: 16/782,920

(22) Filed: Feb. 5, 2020

(65) Prior Publication Data

US 2021/0001966 A1 Jan. 7, 2021

Related U.S. Application Data

(60) Provisional application No. 62/870,401, filed on Jul. 3, 2019.

(51) Int. Cl.

| | |
|---|---|
| ***B63H 20/14*** | (2006.01) |
| ***B63H 20/00*** | (2006.01) |
| ***B63H 20/12*** | (2006.01) |

(52) U.S. Cl.

CPC ..... *B63H 20/14* (2013.01); *B63H 20/007* (2013.01); *B63H 20/12* (2013.01)

(58) Field of Classification Search

CPC ..... B63H 20/14; B63H 20/007; B63H 20/12
See application file for complete search history.

(56) References Cited

U.S. PATENT DOCUMENTS 3,985,380 A * 10/1976 Raivio ..... E05C 19/14 292/69
4,057,020 A * 11/1977 Halliar ..... F16J 13/18 105/377.11
4,733,848 A * 3/1988 Slattery ..... B63H 20/007 248/642
4,872,859 A * 10/1989 Griffiths ..... B63H 20/06 440/53
7,004,804 B2 * 2/2006 Bernloehr ..... B63H 20/007 248/642
10,906,622 B1 * 2/2021 Boks ..... B63H 21/17

OTHER PUBLICATIONS

Printout from https://www.360yardware.com/gate_latch_types.htm, published prior to Feb. 5, 2020.

* cited by examiner

*Primary Examiner* — Stephen P Avila
(74) *Attorney, Agent, or Firm* — Samuel M. Korte; Max M. Ali

(57) ABSTRACT

A mounting assembly for improved latching of a watercraft trolling motor that includes a shaft assembly. The mounting assembly includes a pivot joint configured to be fixed relative to the watercraft. The mounting assembly further includes a swinging bracket assembly having: (a) a swinging bracket having a first end, a second end and a length, the first end being configured for attachment to the shaft assembly and the second end being rotatably attached to the pivot joint; and (b) a latch pin assembly including an elastic element and a latch pin mounted to the swinging bracket. The mounting assembly still further includes a stationary bracket configured to be fixed relative to the watercraft and having a protuberance and a sloped surface receiving the latch pin. Inadvertent removal of the latch pin from a sliding, latched relationship with the sloped surface is obstructed by the protuberance.

20 Claims, 15 Drawing Sheets

TROLLING MOTOR LATCHING SYSTEM

RELATED APPLICATIONS

The present application is a non-provisional application which claims priority benefit with regard to all common subject matter to U.S. Provisional Application Ser. No. 62/870,401, filed Jul. 3, 2019, which is hereby incorporated by reference in its entirety into the present application as if fully set forth herein.

BACKGROUND

Trolling motors mounted to watercraft are typically secured to the watercraft by mounts. Motor mounts are designed to transition between deployed and stowed configurations, and each may include a fastening mechanism for securing the trolling motor in one or both of the configurations. Historically, such fastening mechanisms have been prone to instances of unintentional transition between deployed and stowed configurations (e.g., due to external forces exceeding a fastening mechanism's capacity), to "jamming" or sticking in a deployed or stowed configuration, or both.

SUMMARY

Embodiments of the present technology provide a mounting assembly for improved latching of a watercraft trolling motor that includes a shaft assembly. The mounting assembly includes a pivot joint configured to be fixed relative to the watercraft. The mounting assembly further includes a swinging bracket assembly having: (a) a swinging bracket having a first end, a second end and a length, the first end being configured for attachment to the shaft assembly and the second end being rotatably attached to the pivot joint; and (b) a latch pin assembly including an elastic element and a latch pin mounted to the swinging bracket. The mounting assembly still further includes a stationary bracket configured to be fixed relative to the watercraft and having a protuberance and a sloped surface receiving the latch pin. The elastic element is coupled to the latch pin, and the latch pin is mounted to be slidable in a first direction along a portion of the length of the swinging bracket to generate an opposing elastic force in the elastic element in a second direction opposite the first direction. The latch pin also includes a ramped surface pressed against the sloped surface of the stationary bracket by the opposing elastic force in a sliding, latched relationship. The protuberance is positioned along an end of the sloped surface to obstruct sliding movement of the latch pin beyond the sloped surface and to maintain the latched relationship with the sloped surface.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 9:
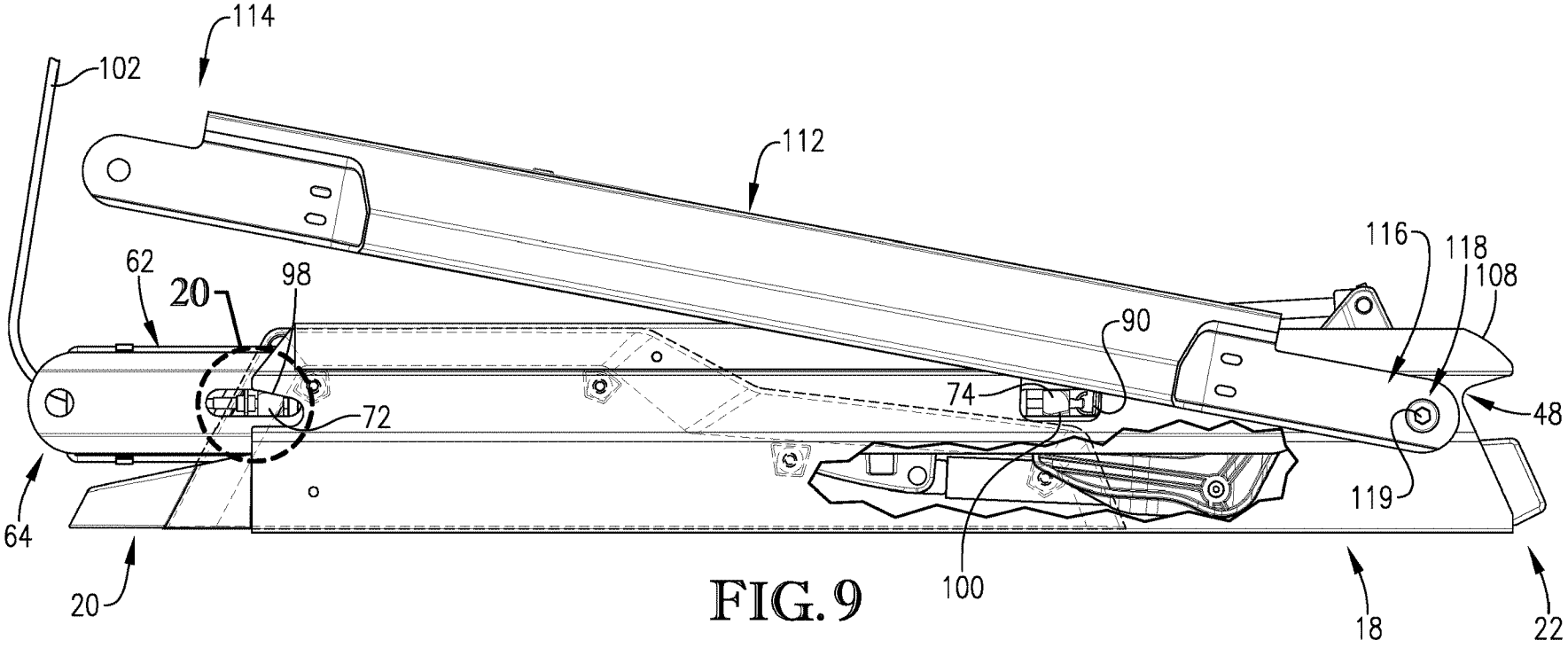
FIG. 9 is a partial side elevation of the mounting assembly of FIG. 1 in a deployed configuration, with near portions of the plastic casing and part of a sidewall of the stationary bracket removed to reveal a latch pin of the latch pin assembly in latching engagement with front sloped surfaces of the stationary bracket as well as a portion of a gas spring assembly of the mounting assembly.
Figure 10:
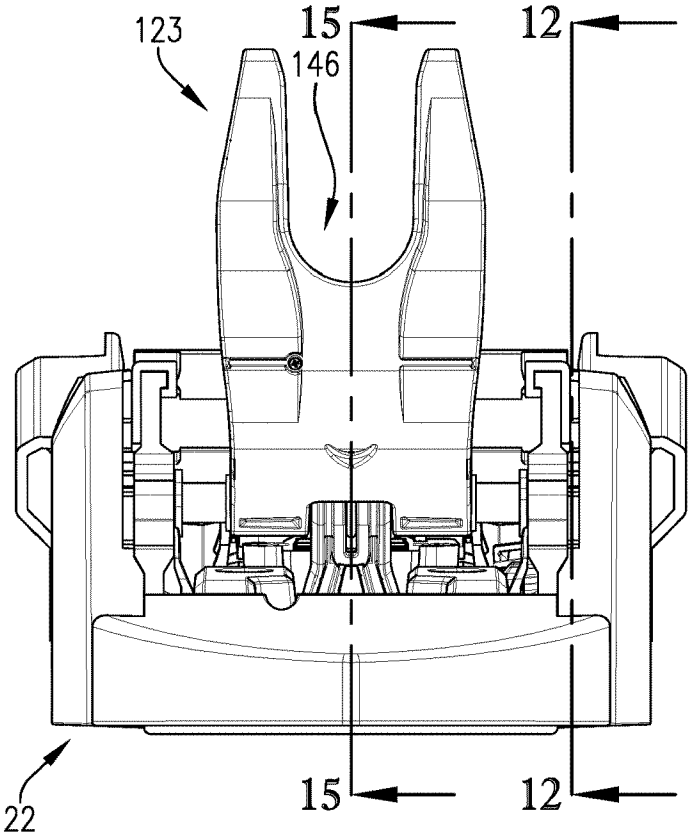
FIG. 10 is a front elevation of the mounting assembly of FIG. 1.
Figure 11:
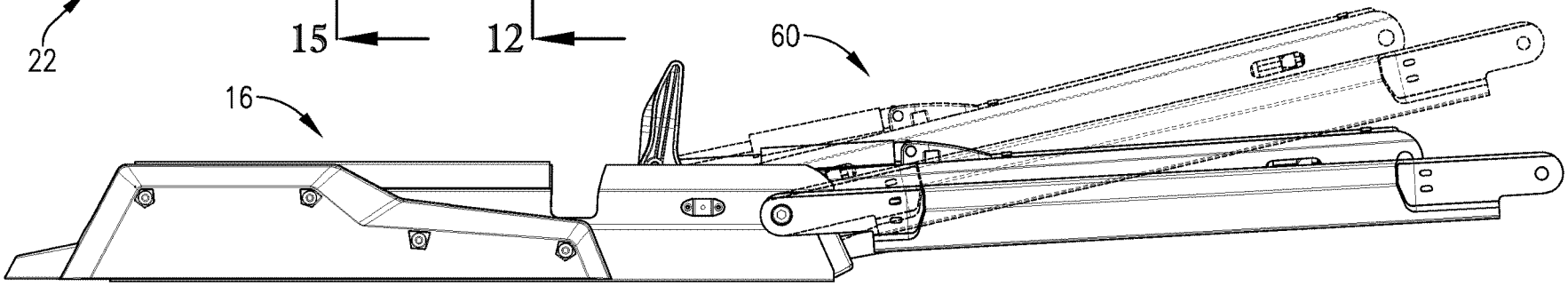
FIG. 11 is a side elevation of the mounting assembly of FIG. 1, with swinging brackets shown in dotted lines in a first position and in solid lines in a second position corresponding to a stowed configuration.
Figure 12:
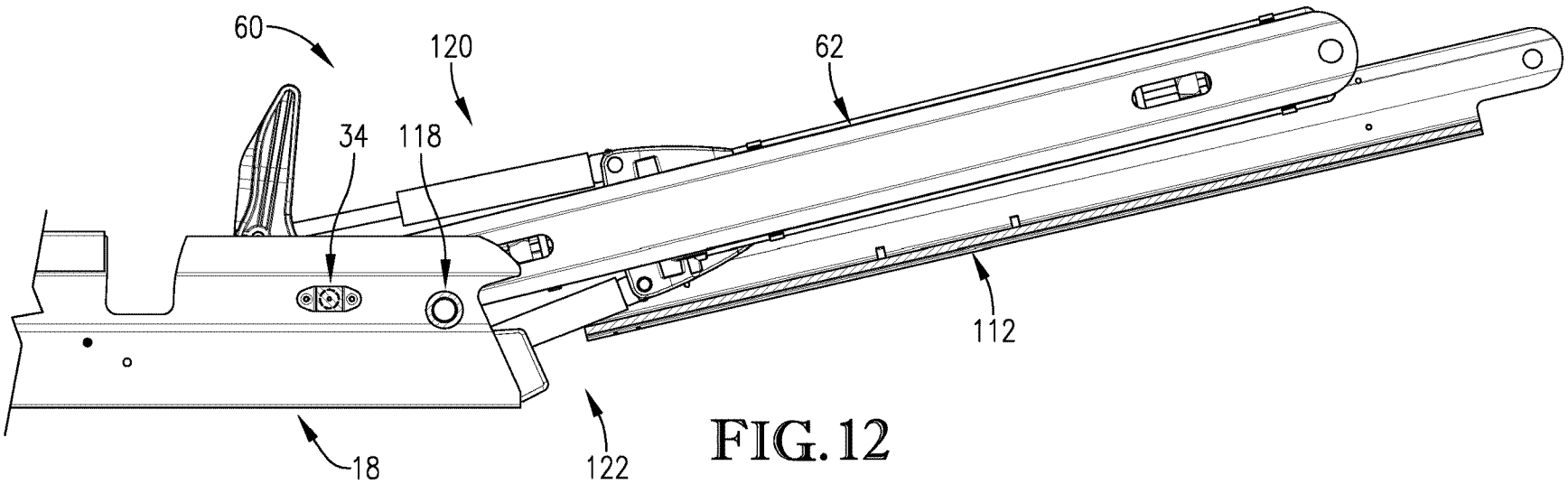
FIG. 12 is a partial cross section of the mounting assembly of FIG. 1, taken along line 12-12 from FIG. 10, illustrating a second latch pin of the latch pin assembly being leveraged along a rear charging slope of the stationary bracket.
Figure 13:
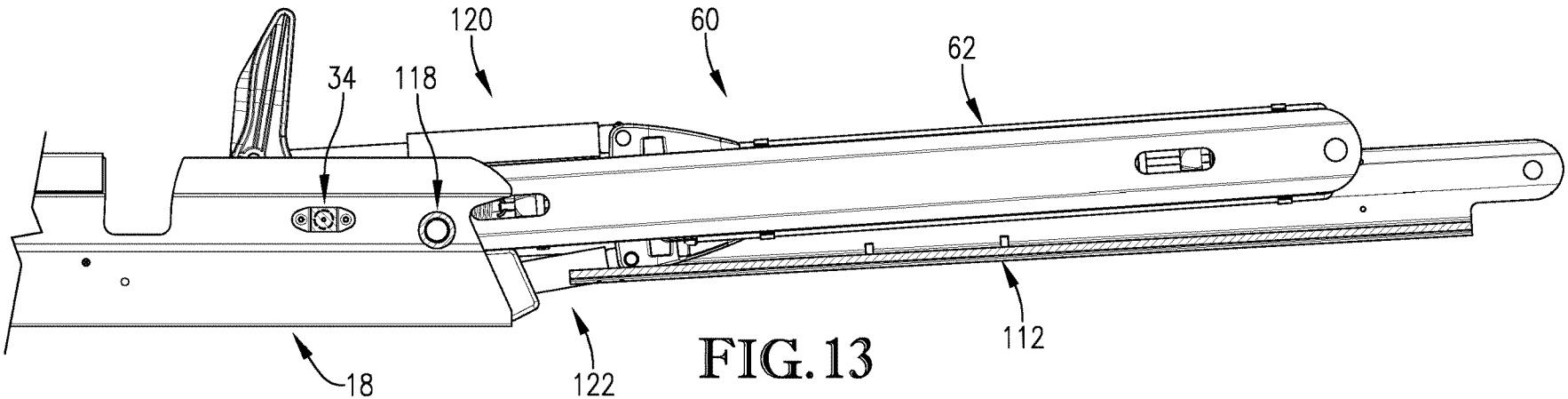
FIG. 13 is a side elevation of the cross section of FIG. 12, illustrating further rotation of the swinging brackets toward a stowed configuration.
Figure 14:
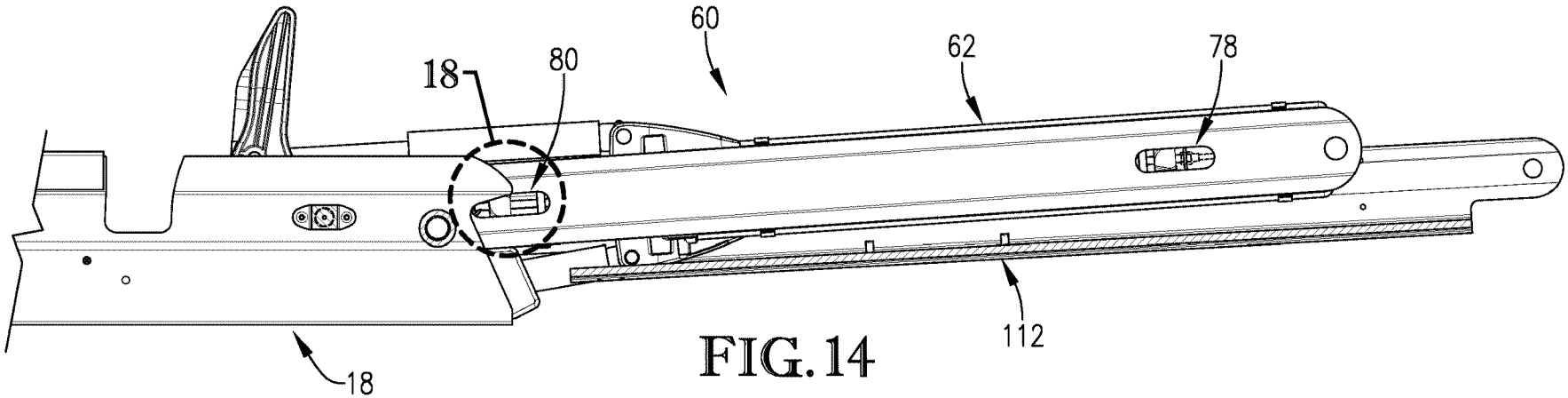
FIG. 14 is a side elevation of the cross section of FIG. 12, illustrating latched engagement between a ramped surface of the second latch pin and a corresponding sloped surface along a rear edge of the stationary bracket in a stowed configuration.
Figure 15:
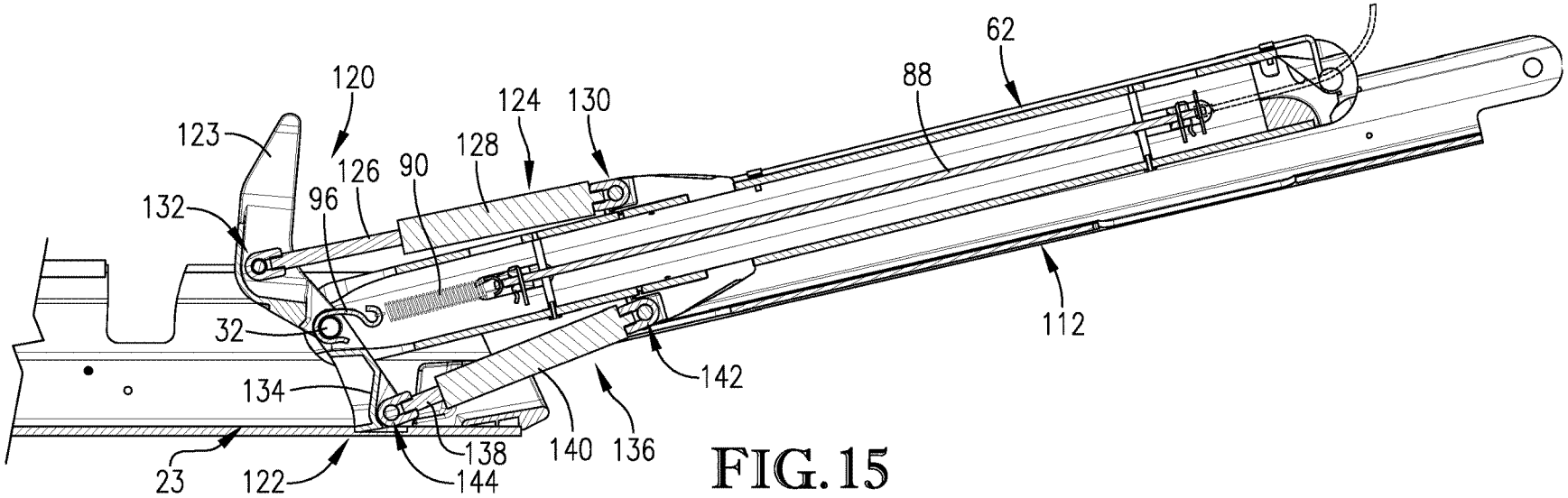
FIG. 15 is a partial cross section of the mounting assembly of FIG. 1, taken along line 15-15 from FIG. 10, illustrating portions of the swinging brackets, gas spring assemblies and latch pin assembly positioned near the stowed configuration.
Figure 16:
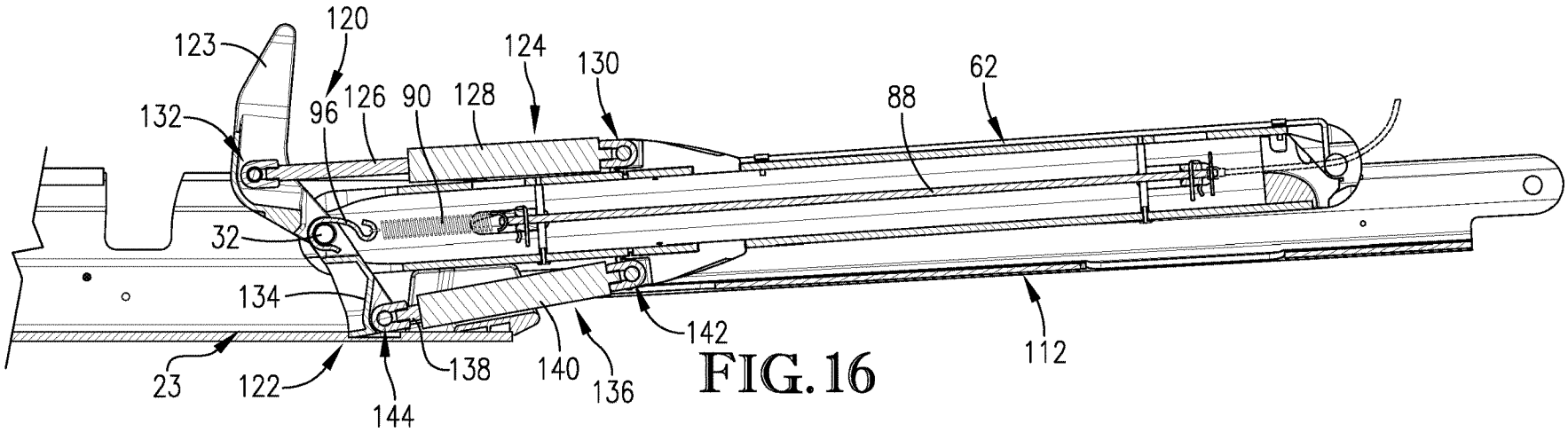
FIG. 16 is a side elevation of the cross section of FIG. 15, illustrating the swinging brackets and gas spring assemblies in position for the stowed configuration and a tension spring of the latch pin assembly extended in a first direction for generation of an opposing elastic force in a second direction.
Figure 21:
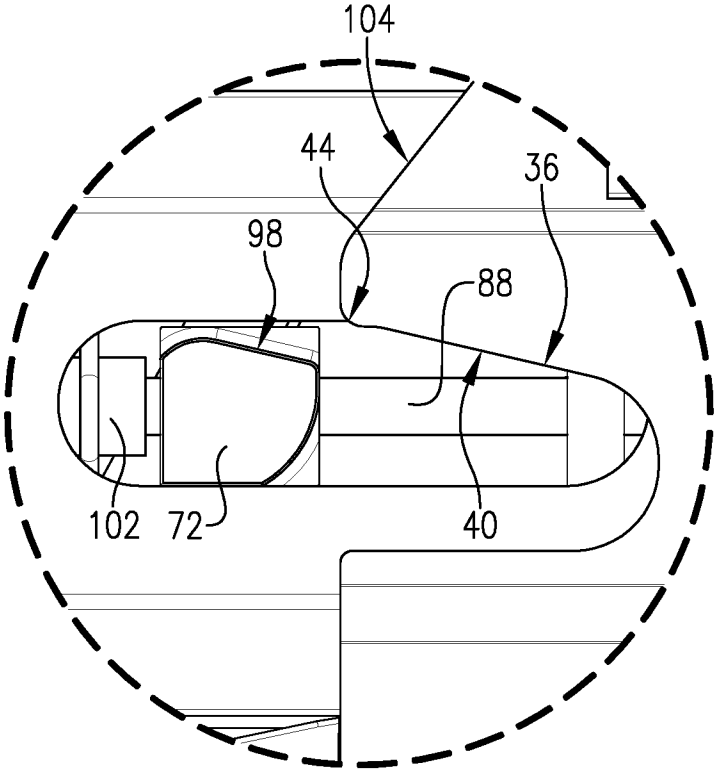
Figure 20:
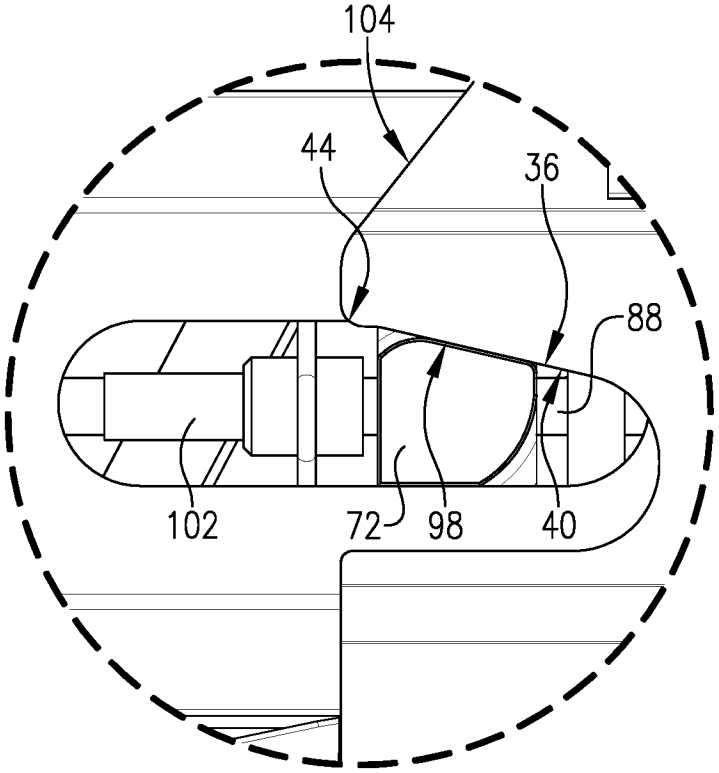

FIG. 20 is an enlarged view of the first latch pin of FIG. 9, illustrating latched engagement of the first latch pin and the corresponding sloped surface adjacent a protuberance along an external end of a front edge of the stationary bracket in a deployed configuration; and FIG. 21 is the enlarged view of the first latch pin of FIG. 20, illustrating the first latch pin in a second position translated in the first direction out of latched engagement with the corresponding sloped surface of the front edge.

The drawing figures do not limit the present technology to the specific embodiments disclosed and described herein. While the drawings do not necessarily provide exact dimensions or tolerances for the illustrated components or structures, the drawings are to scale as examples of certain embodiments with respect to the relationships between the components of the structures illustrated in the drawings.

DETAILED DESCRIPTION

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the present technology. The following detailed description is, therefore, not to be taken in a limiting sense.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present technology relate to a mounting system for a watercraft trolling motor. A conventional trolling motor may include a shaft assembly connecting a mounting system to a motor assembly. The mounting system is designed to transition between deployed and stowed configurations. When in a deployed configuration, the mounting system will hold the shaft assembly in a particular orientation with respect to the watercraft to ensure the motor assembly contacts and/or is submerged in a body of water. When in a stowed configuration, the mounting system will hold the shaft assembly in a second orientation with respect to the watercraft that ensures the motor assembly is not submerged in the water. The mounting system may hold the motor assembly near or just above an edge or gunwale of the watercraft's hull in a stowed configuration.

Retaining a stowed or deployed configuration commonly includes the use of a fastening mechanism. Conventional fastening mechanisms attempt to prevent unintentional transition from the stowed or deployed configuration—for instance when a watercraft is bouncing along rough water or is being bumped as a result of road transport on a trailer. However, such conventional systems also tend to stick or "jam," making intentional transition of the mounting system between configurations difficult.

Embodiments of the present technology provide an improved latching system and mounting assembly that reduce the likelihood of a trolling motor "jamming" or "sticking" in a stowed or deployed configuration, without significantly increasing the risk of unintentional transition. Moreover, various embodiments of the present technology provide an improved latching system and mounting assembly for reduction of bouncing or "slop" in one or both configurations.

An exemplary improved trolling motor according to embodiments of the present technology includes a mounting assembly attached to a shaft assembly, with the shaft assembly being attached to a motor assembly. The mounting assembly includes a stationary bracket fixed relative to the watercraft and a pivot element (e.g., a pivot pin) fixed adjacent an end of the stationary bracket. The mounting assembly further includes a swinging bracket assembly having a swinging bracket. The swinging bracket is rotatably attached along one end to the stationary bracket at the pivot element. The swinging bracket assembly also includes a latch pin assembly comprising an elastic element and a latch pin mounted to the swinging bracket.

The latch pin is coupled to one end of the elastic element. An opposite end of the elastic element is coupled to the pivot element. The latch pin is slidable in a slot of the swinging bracket in a first direction along a portion of the length of the swinging bracket. The translation of the latch pin along the swinging bracket in the first direction generates an opposing force in the elastic element in a second direction substantially opposite the first direction. The first direction and the second direction lie on an axis of translation for the latch pin generally extending along the length of the swinging bracket.

The stationary bracket includes an edge having a sloped surface and a protuberance positioned along one end of the sloped surface. The protuberance may be on an external end of the sloped surface. It is foreseen, however, that a protuberance may be located on an internal end of a sloped surface without departing from the spirit of the present technology. The latch pin includes a correspondingly-angled ramped surface configured to be received against the sloped surface in a latching relationship corresponding to a stowed or a deployed configuration. The ramped surface of the latch pin is pressed against the sloped surface of the stationary bracket by the opposing force generated in the elastic element.

Because the latch pin slides within a slot of the swinging bracket and is substantially confined to movement along a portion of the length of the swinging bracket, rotation of the swinging bracket while latched, if any, generally corresponds to movement of the latch pin along the sloped surface. Movement of the latch pin past an internal end of the sloped surface of the stationary bracket may be constrained by one or more of: an end of the slot of the swinging bracket within which the latch pin slides; a gas spring assembly fixed to the swinging bracket, as discussed in more detail below; another structure bounding the range of rotation of the swinging bracket, or other such impediments.

On the other hand, movement of the latch pin past the external or open end of the sloped surface of the stationary bracket may be constrained by the protuberance. That is, environmental forces (i.e., those not associated with intentional transitions by an operator) that might urge the latch pin along the sloped surface in the first direction are generally insufficient to force the latch pin over the protuberance. The latching relationship is thereby maintained against inadvertent release. Accordingly, extreme or outlier environmental vibrations or impacts that might have caused prior art fastening mechanisms to inadvertently release from a latched relationship are not able to dislodge the swinging bracket of embodiments of the present technology. Moreover, such stability and slop-reduction may be achieved without sacrificing ease of use for an operator seeking to transition the mounting assembly from stowed to deployed configurations or vice versa. This is at least because the protuberance does not substantially impede an operator's attempts to pull the latch pin away from the sloped surface in the first direction for disengagement from the latching relationship.

Embodiments of the technology will now be described in more detail with reference to the drawing figures. Referring to FIGS. 1-5, a trolling motor 10 includes a motor assembly 12, a shaft assembly 14 including a steering assembly 15, and a mounting assembly 16. The shaft assembly 14 also includes a shaft 17. The steering assembly 15 rotatably attaches the shaft 17 to the mounting assembly 16.

The mounting assembly 16 includes a stationary bracket 18 fixed relative to a watercraft (not shown). The stationary bracket has a first end 20, a second end 22, a length L1 and a width W. The stationary bracket 18 includes a bottom wall 23 and a pair of sidewalls 24, 26 spaced across the width W and extending generally in parallel with one another. The stationary bracket 18 may be fixed to the watercraft via fasteners inserted through fastener holes in the bottom wall 23 (see FIG. 3), clamps, or other fasteners.

Figure 7:
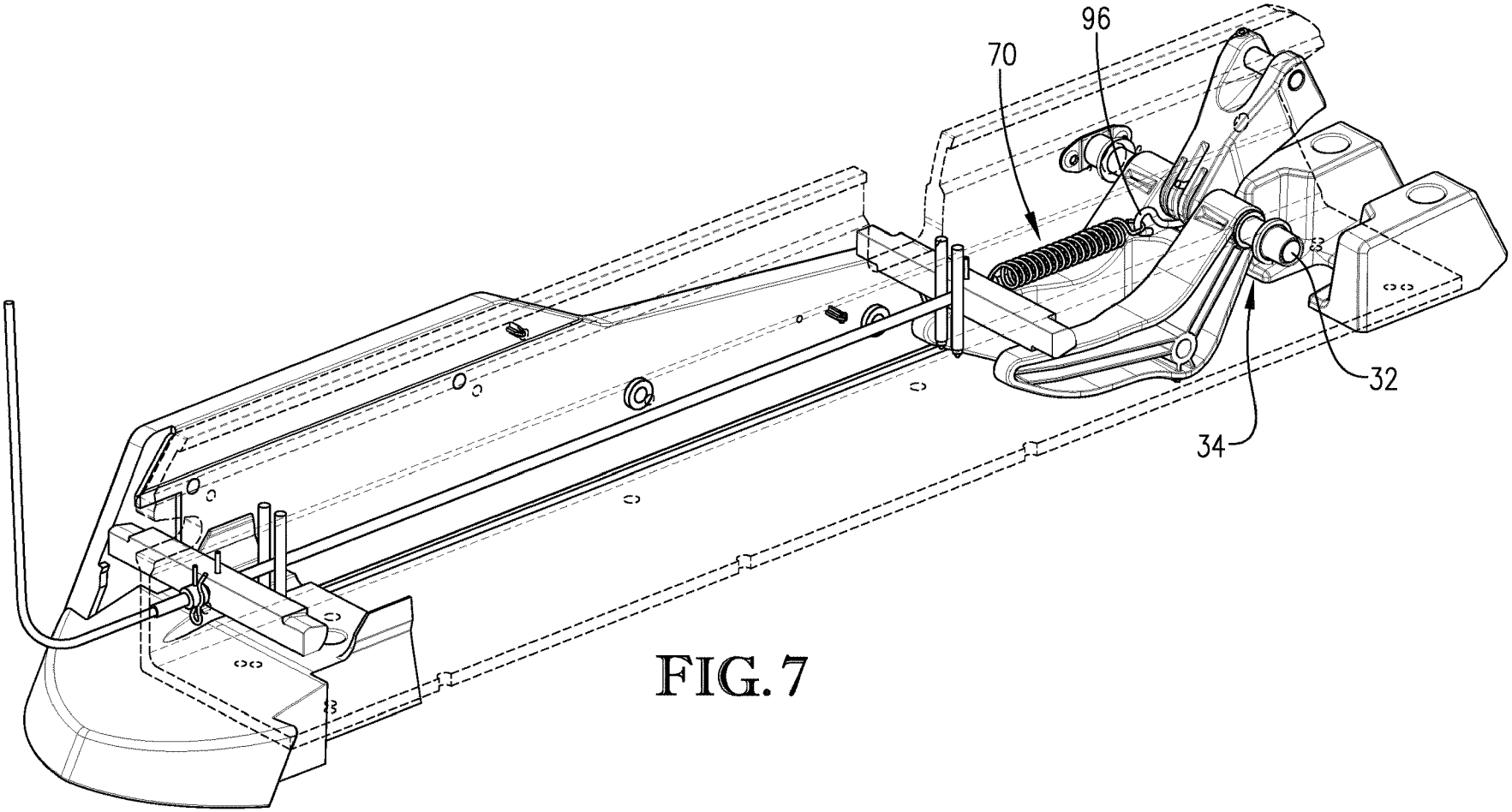
FIG. 7 is a partial front perspective view of the mounting assembly of FIG. 2, with the brackets and plastic casing respectively being partially or entirely removed and part of the stationary bracket being hidden and outlined in broken lines to reveal details of the latch pin assembly and stopping arms rotatable about the pivot pin.

The sidewalls 24, 26 respectively define pin holes 28, 30 at corresponding locations adjacent the second end 22 of the stationary bracket 18. (See FIG. 5) The mounting assembly 16 includes a pivot pin 32 extending through the pin holes 28, 30 to form a pivot element or pivot joint 34 (see FIG. 7), as described in more detail below.

The sidewalls 24, 26 also respectively include first edges 36, 38 adjacent the first end 20 of the stationary bracket 18. (See FIG. 5) The first edges 36, 38 respectively include corresponding sloped surfaces 40, 42 and protuberances 44, 46. The protuberances 44, 46 are respectively positioned along outside or open ends of the sloped surfaces 42, 42. The first edges 36, 38 have generally corresponding positions along the length L1 of the stationary bracket 18 adjacent the first end 20.

Likewise, the sidewalls 24, 26 respectively include second edges 48, 50 adjacent the second end 22 of the stationary bracket 18. The second edges 48, 50 respectively include sloped surfaces 52, 54 and protuberances 56, 58. The protuberances 56, 58 are respectively positioned along outside or open ends of the sloped surfaces 52, 54. The second edges 48, 50 similarly have generally corresponding positions along the length L1 of the stationary bracket 18 adjacent the second end 22. The first edges 36, 38 open in a substantially opposite direction from the second edges 48, 50, owing to participation in different latching relationships (respectively, deployed and stowed latching relationships, as discussed in more detail below).

Figure 6:
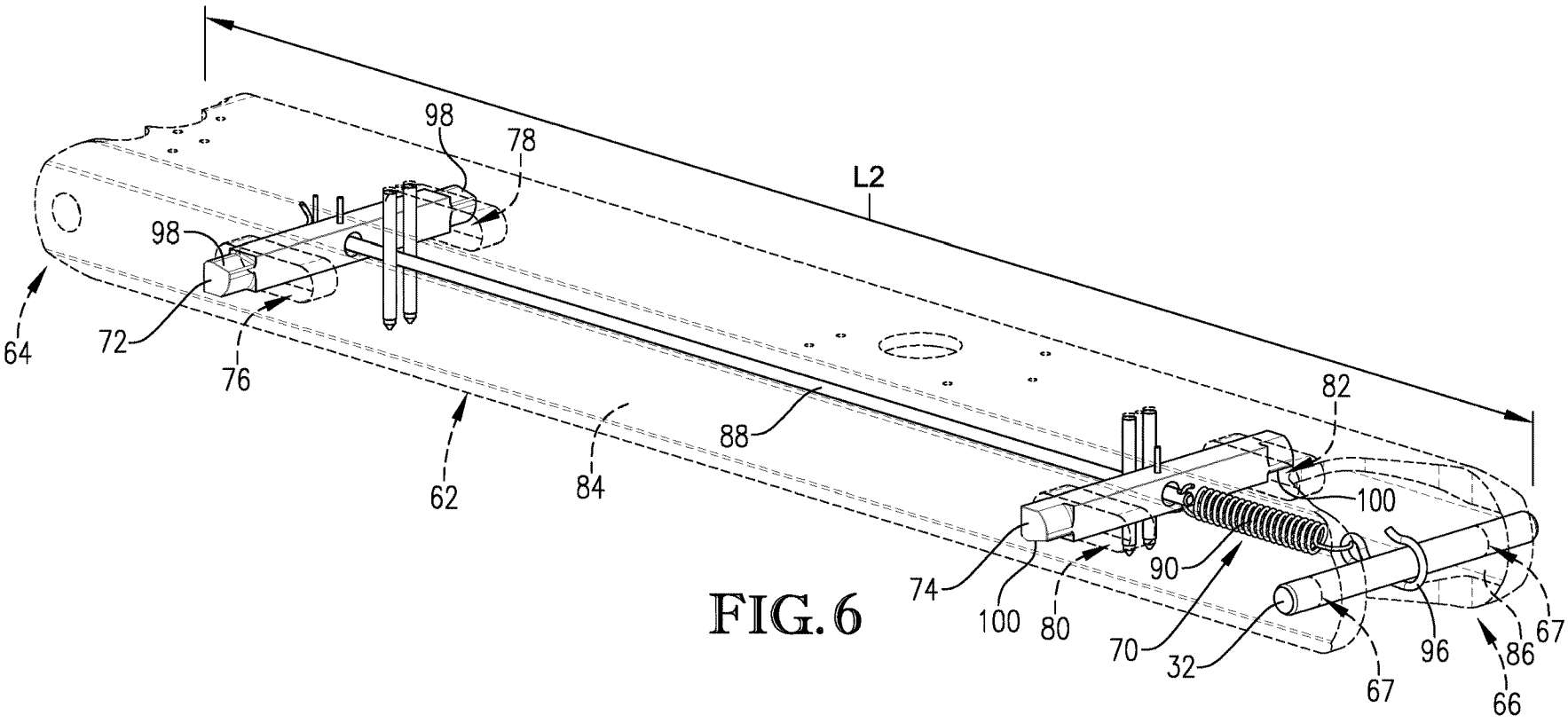
FIG. 6 is a rear perspective view of the latch pin assembly and a pivot pin mounted to the inner swinging bracket of FIG. 2, the inner swinging bracket being hidden and outlined in broken lines.

The mounting assembly 16 also includes a swinging bracket assembly 60. The swinging bracket assembly 60 includes a swinging bracket 62 having a first end 64, a second end 66 and a length L2. (See FIG. 6) The first end 64 of the swinging bracket 62 is attached to the shaft assembly 14 and the second end 66 is rotatably attached to the pivot joint 34 by the pivot pin 32. Namely, the pivot pin 32 extends through opposite pin holes 67 defined along the second end 66 of the swinging bracket 62 at positions that correspond to and align with the pin holes 28, 30 of the stationary bracket 18.

Figure 8:
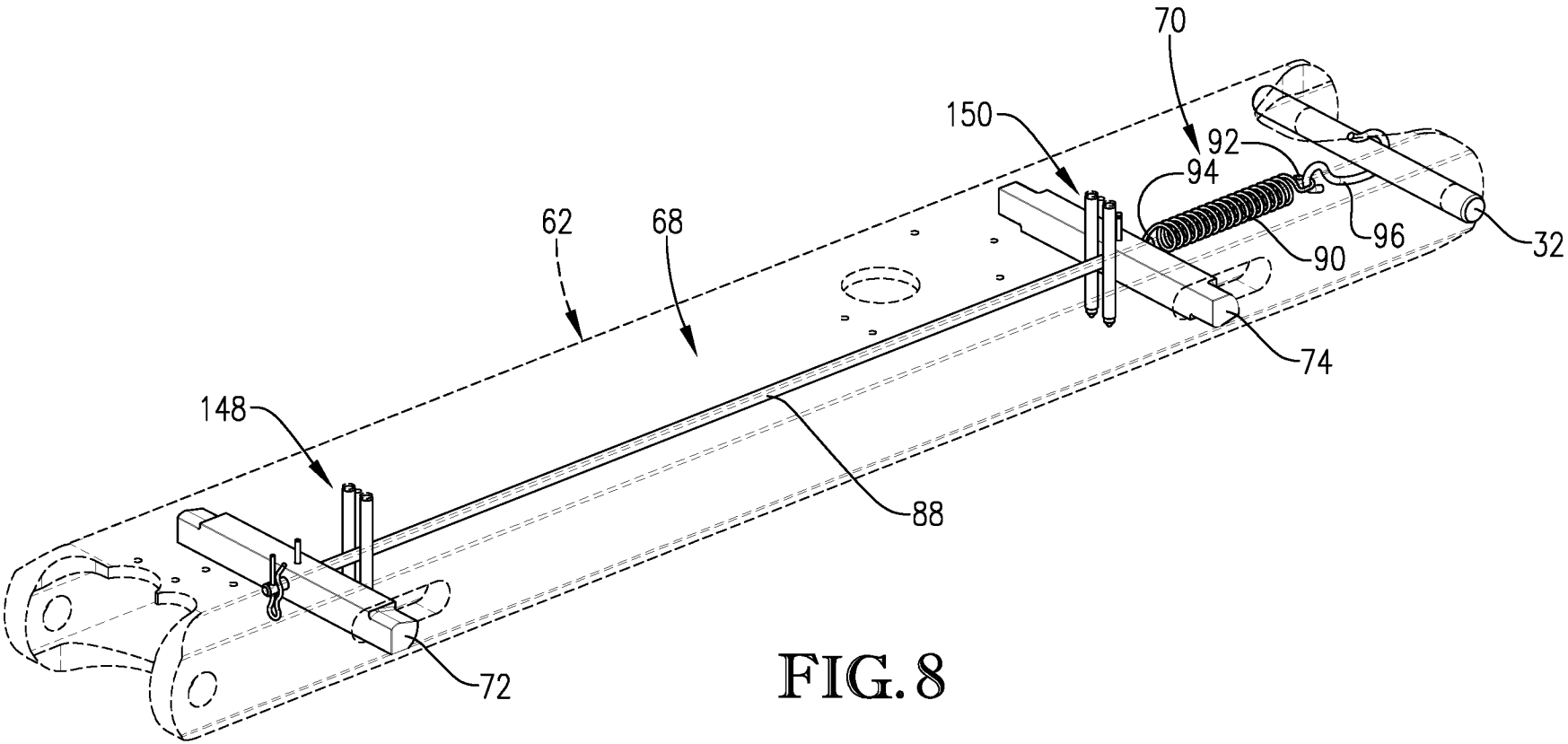
FIG. 8 is a front perspective view of the latch pin assembly and pivot pin mounted to the hidden inner swinging bracket of FIG. 6.

The swinging bracket assembly 60 also includes a latch pin assembly 68 having an elastic element 70 and first and second latch pins 72, 74 mounted to the swinging bracket 62. (See FIG. 8) The first latch pin 72 is mounted in opposing slots 76, 78 defined adjacent the first end 64 of the swinging bracket 62. (See FIG. 6) The second latch pin 74 is mounted in slots 80, 82 defined adjacent the second end 66 of the swinging bracket 62. More particularly, the swinging bracket 62 includes a sidewall 84 that defines the slots 76, 80, and a sidewall 86 that defines the slots 78, 82, the sidewalls 84, 86 extending substantially in parallel and being spaced apart in the width dimension. The latch pins 72, 74 are respectively mounted within the slots 76, 78 and 80, 82 so as to be slidable within limited ranges along the length L2 of the swinging bracket 62.

The elastic element 70 may include a substantially rigid rod 88 attached to a spring 90. The spring 90 is coupled to the first and second latch pins 72, 74 via the rod 88, so that moving any of the rod 88, the first latch pin 72 or the second latch pin 74 results in corresponding movement of the others. Moreover, the spring 90 may be a tension spring, with a first end 92 rotatably attached to the pivot pin 32 and a second end 94 coupled to the rod 88. More particularly, the spring 90 may be rotatably attached to the pivot pin 32 by an S-hook 96 or the like.

Movement of the rod 88 in a first direction along the length of the swinging bracket 62 (i.e., toward the first end 64) may correspond to movement of the first latch pin 72, the second latch pin 74, and the second end 94 of the tension spring 90 in the first direction. This movement may generate an opposing force in the tension spring 90 directed in a second direction opposite the first direction, urging the latch pin assembly 68 toward the second end 66 of the swinging bracket 62.

One of ordinary skill will appreciate that a variety of elastic elements in various configurations may be employed to generate an opposing force in a second direction in response to movement of latch pin(s) and/or a rod in a first direction within the scope of the present technology.

Figure 1:
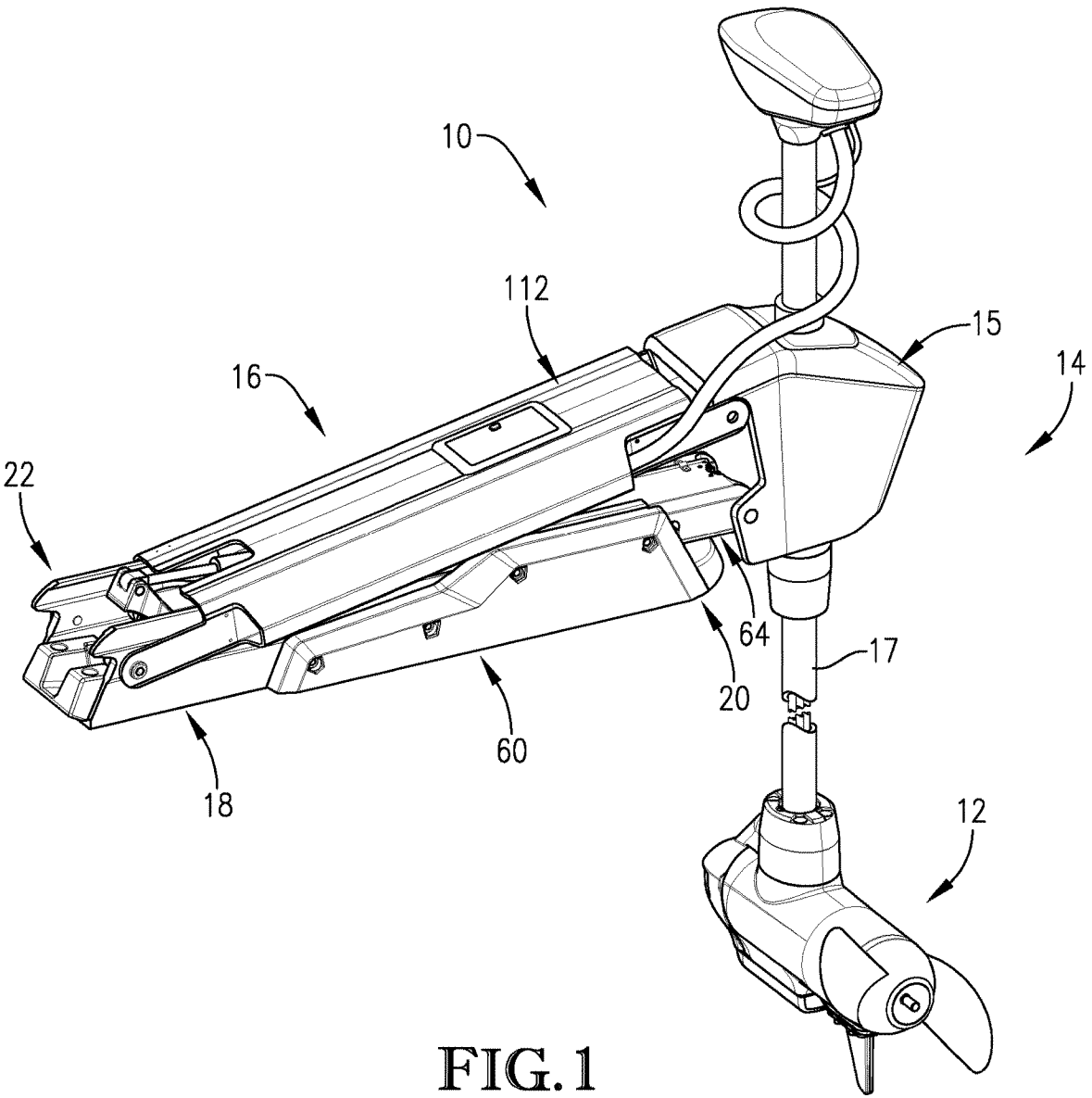
FIG. 1 is a side perspective view of a trolling motor incorporating an improved mounting assembly constructed in accordance with embodiments of the present technology.
Figure 2:
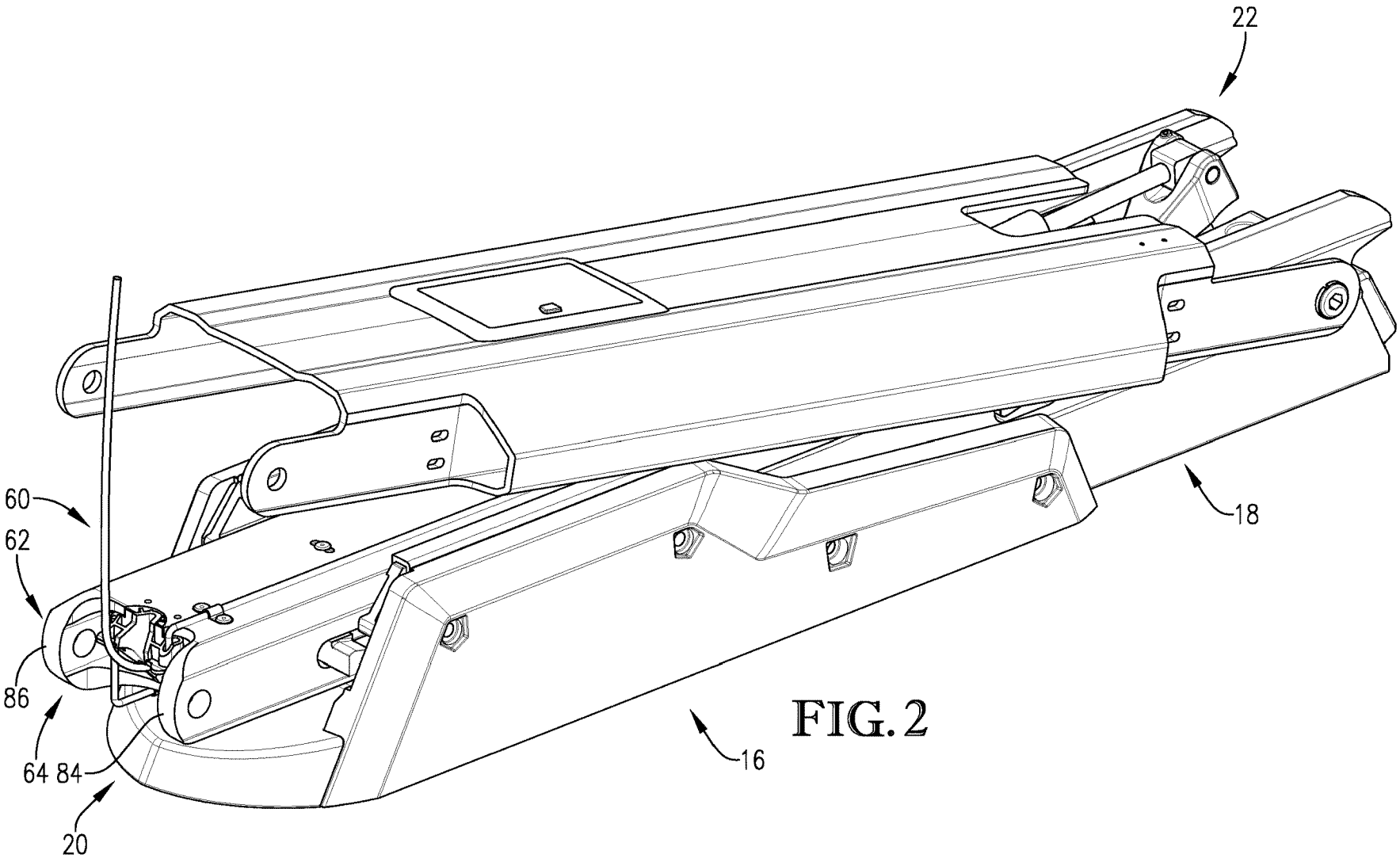
FIG. 2 is a front perspective view of the mounting assembly of FIG. 1, the mounting assembly including a stationary bracket and outer and inner swinging brackets.
Figure 3:
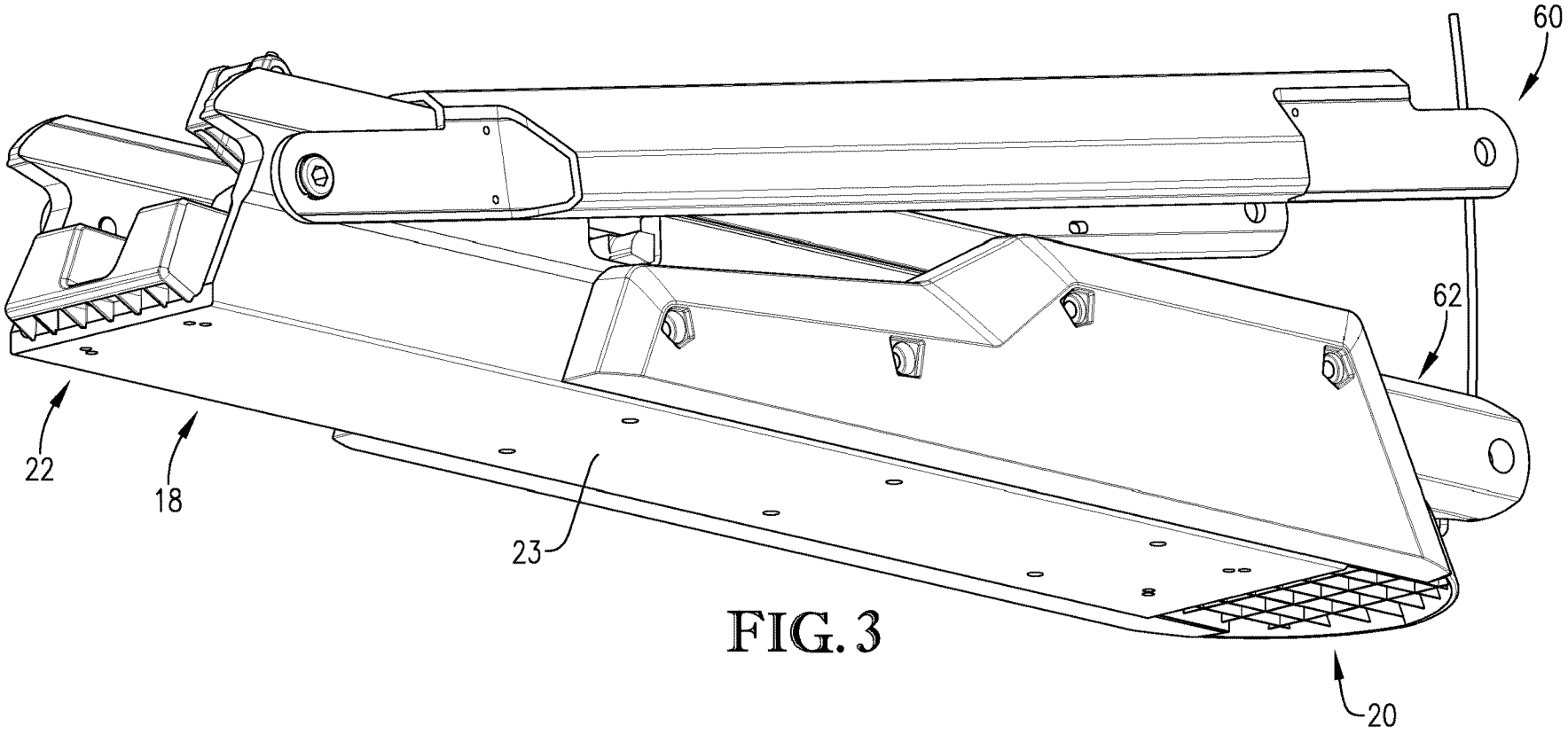
FIG. 3 is a rear perspective view of the mounting assembly of FIG. 1.
Figure 4:
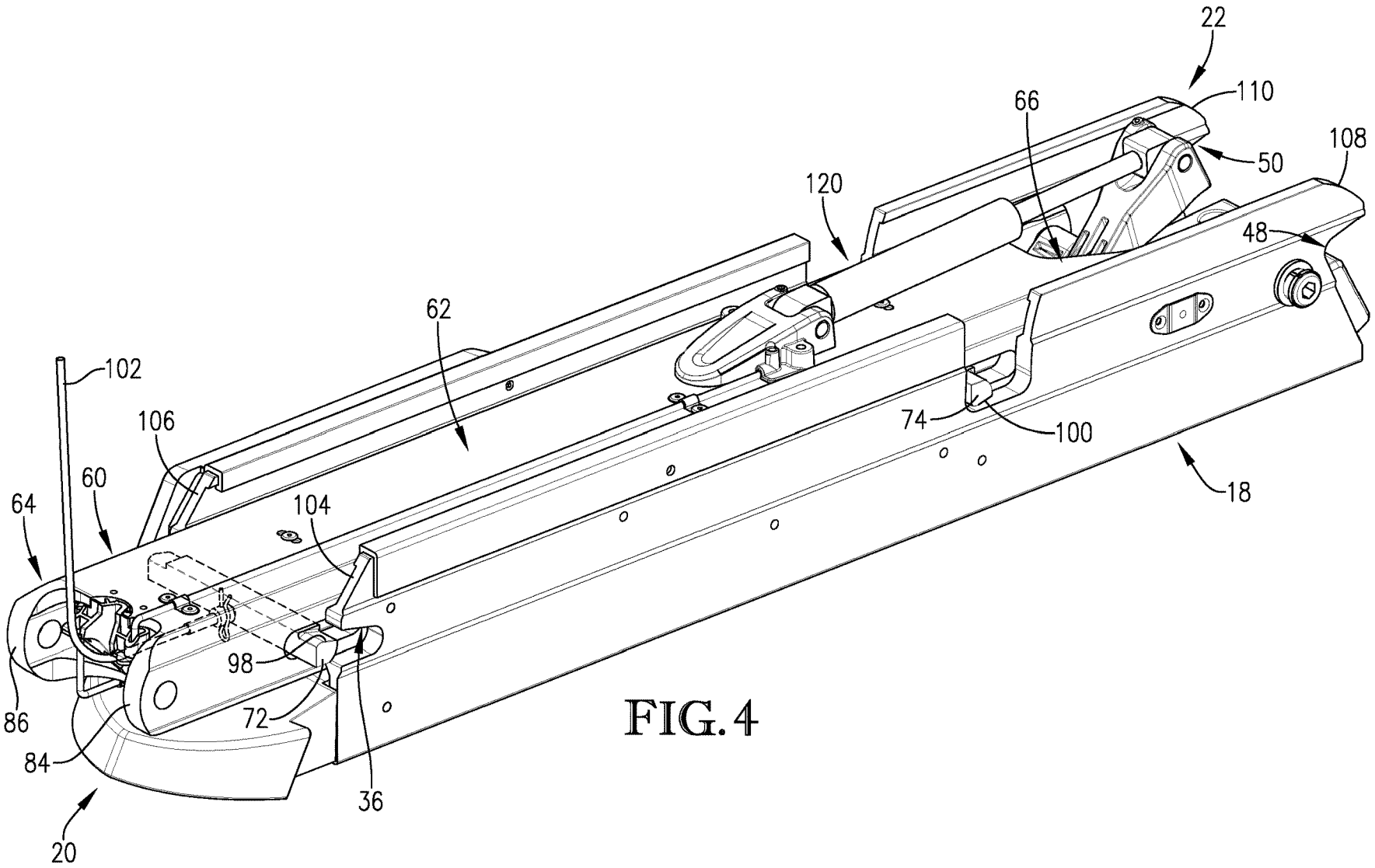
FIG. 4 is a front perspective view of the mounting assembly of FIG. 2, the outer swinging bracket and plastic casing being removed to reveal details of the inner swinging bracket and a latch pin assembly mounted partly therein, with hidden portions of the latch pin assembly outlined in broken lines.
Figure 5:
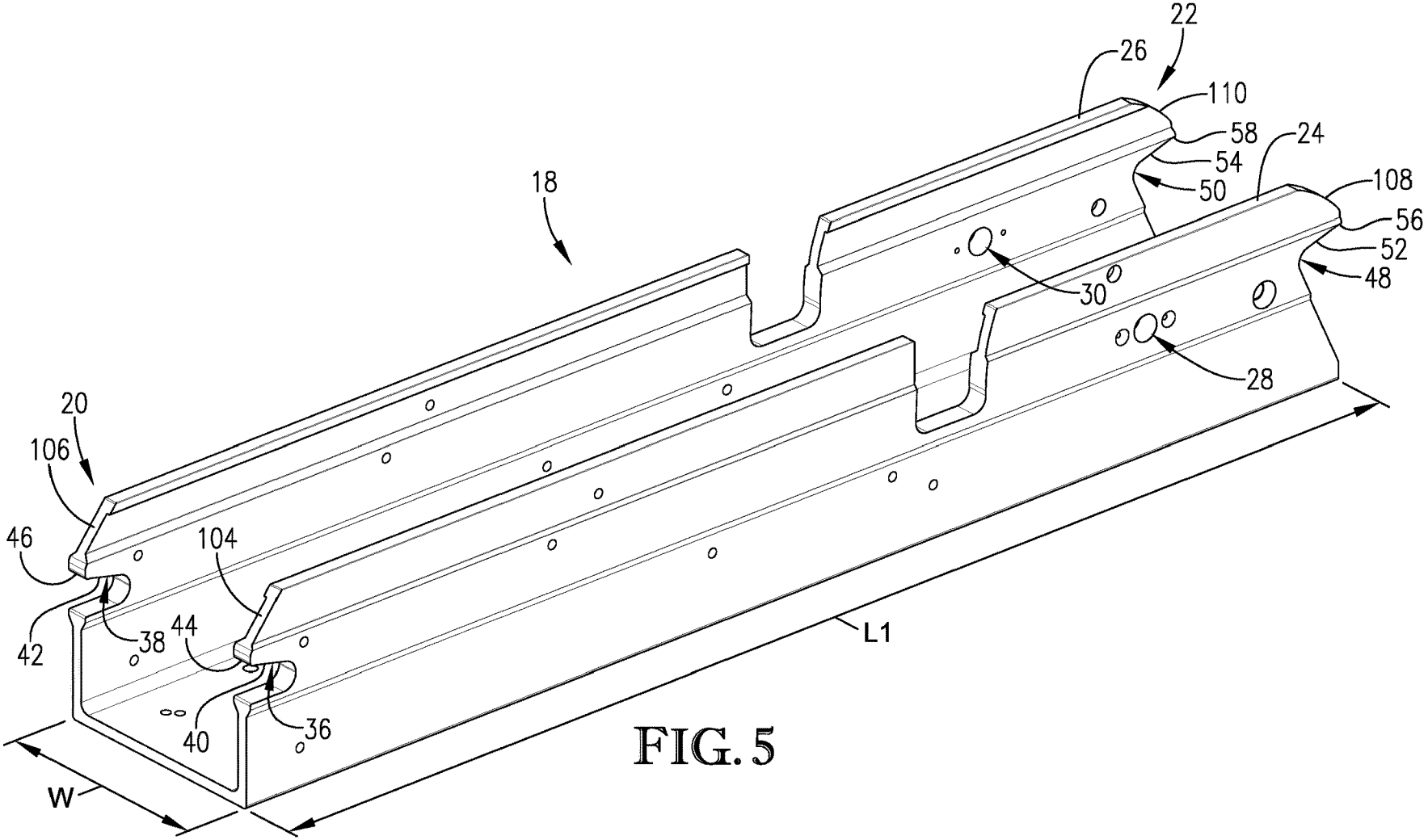
FIG. 5 is a front perspective view of the stationary bracket of FIG. 2.
Figure 17:
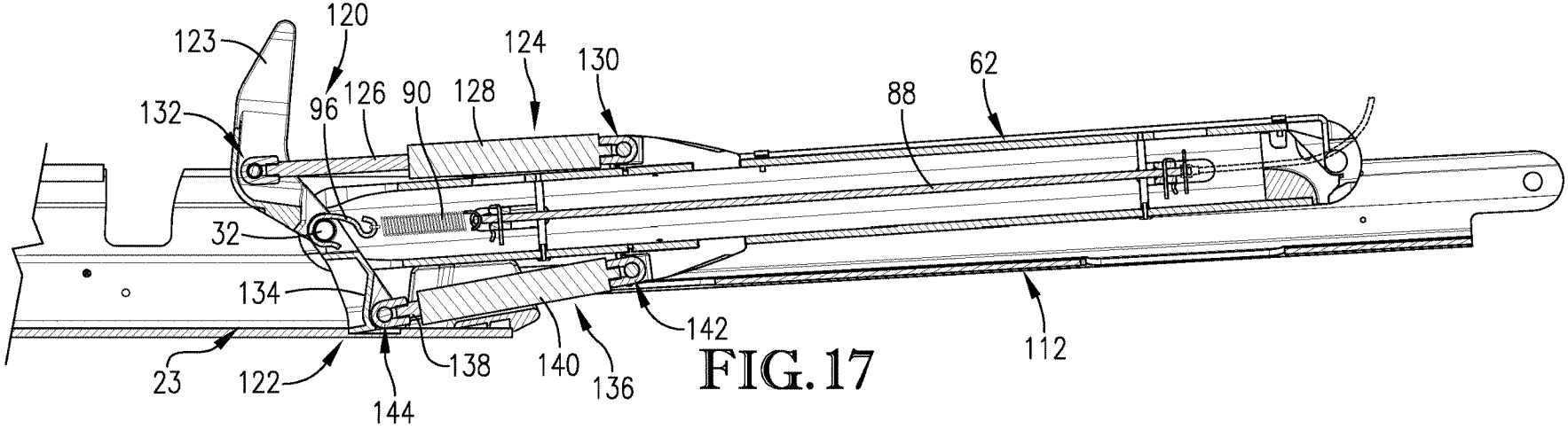
FIG. 17 is a side elevation of the cross section of FIG. 16, illustrating the tension spring released and retracted in the second direction in correspondence with the stowed configuration.

The first latch pin 72 generally extends across the width W of the stationary bracket 18 to reach or extend beyond the first edges 36, 38 of the stationary bracket 18. The first latch pin 72 is configured for engagement in a latched relationship with the first edges 36, 38 when the trolling motor 10 is in a deployed configuration (i.e., when the swinging bracket 62 is generally folded over on top of the stationary bracket 18 as shown in FIG. 3). Similarly, the second latch pin 74 generally extends across the width W of the stationary bracket 18 to reach or extend beyond the second edges 48, 50 of the stationary bracket 18. The second latch pin 74 is configured for engagement in a second latched relationship with the second edges 48, 50 when the trolling motor 10 is in a stowed configuration (i.e., when the swinging bracket 62 is rotated about the pivot joint 34 away from the stationary bracket 18 to form a nearly straight angle with the stationary bracket 18 as shown in FIG. 17).

More particularly, the latch pins 72, 74 respectively include ramped surfaces 98, 100 along end portions. The ramped surfaces 98, 100 are configured respectively for latching engagement with the sloped surfaces 40, 42 and 52, 54 of the sidewalls 24, 26. In either of the trolling motor 10 configurations, one of the latch pins 72, 74 can be pulled via the rod 88 in the first direction (i.e., toward the first end 64) to "charge" or generate an opposing force in the spring 90 in the second direction (i.e., toward the second end 66). The mounting assembly 16 may include a pull string or cord 102 attached to the rod 88 to facilitate pulling of the rod 88. (See FIG. 9)

The sidewalls 24, 26 respectively incorporate charging slopes 104, 106 adjacent edges 36, 38. (See FIG. 5) The sidewalls 24, 26 also respectively incorporate charging slopes 108, 110 adjacent edges 48, 50. The charging slopes 104, 106 are configured to assist an operator in charging the latch pin assembly 68—and, more particularly, the first latch pin 72—for latching engagement with the edges 36, 38 in the deployed configuration. Likewise, the charging slopes 108, 110 are configured to assist the operator in charging the second latch pin 74 for latching engagement with edges 48, 50 in the stowed configuration. An operator may pull downward on the cord 102 (optionally coupled with an outward tug) to leverage the incline surfaces and slide one of the latch pins 72, 74 along the corresponding pair of charging slopes 104, 106 or 108, 110, thereby stretching the spring 90 to charge the latch pin assembly 68 for either the stowed or the deployed configuration.

Once one of the latch pins 72 or 74 has been pulled down respectively past the corresponding pair of charging slopes 104, 106 or 108, 110, the cord 102 is released. The charged latch pin assembly 68 rebounds in the second direction into latching engagement with either edges 36, 38 (in a deployed configuration, see FIG. 20) or 48, 50 (in a stowed configuration see FIGS. 18-19). More particularly, and using the deployed configuration as an example, the ramped surfaces 98 of the latch pin 72 are forced in the second direction into engagement with the sloped surfaces 40, 42 of the edges 36, 38. Likewise, using the stowed configuration as an example, the ramped surfaces 100 of the latch pin 74 are forced in the second direction into engagement with the sloped surfaces 52, 54 of the edges 48, 50.

Turning more specifically to FIGS. 18-21, the first direction and second direction define an axis of translation AT for the latch pins 72, 74. In an engaged or latched relationship, the ramped surfaces 98, 100 and their respective pairs of corresponding sloped surfaces 40, 42 and 52, 54 generally have corresponding or matching slopes with respect to the axis of translation AT.

Figure 19:
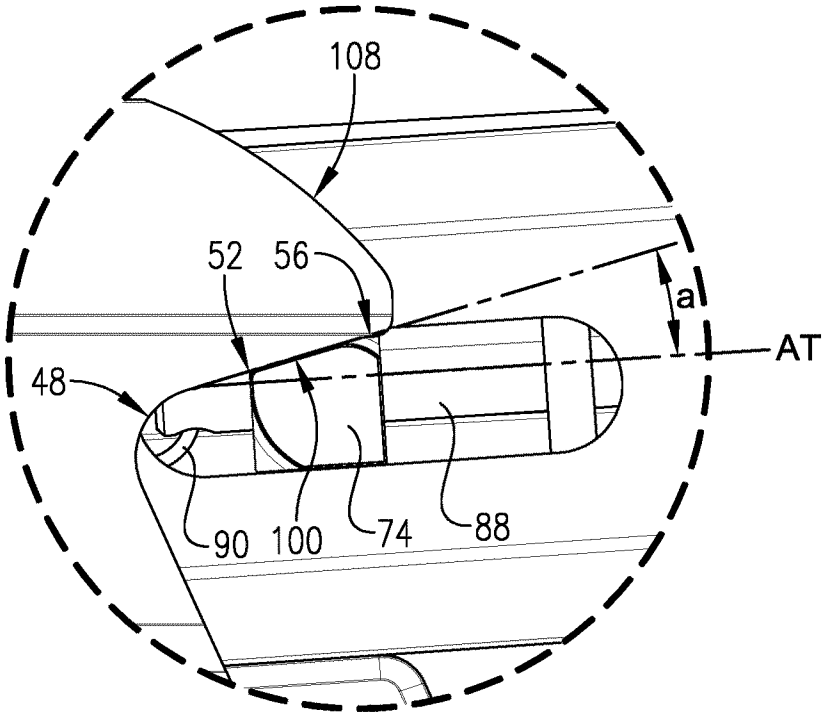
FIG. 19 is the same as FIG. 18, additionally illustrating an axis of translation and angle formed between the axis of translation and the surface of the second latch pin.
Figure 18:
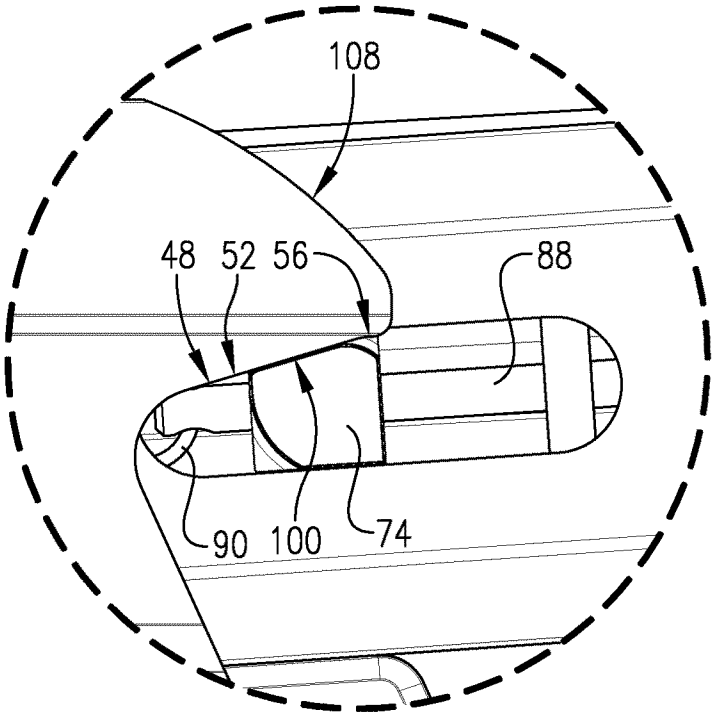
FIG. 18 is an enlarged view of the second pin of FIG. 14, illustrating latched engagement of the second latch pin and the corresponding sloped surface adjacent a protuberance along an external end of the rear edge of the stationary bracket in a stowed configuration.

More particularly, and using the latch pin 74 as an example, the ramped surface 100 may form an acute angle a with the axis of translation AT while maintained in a latched, stowed configuration (see FIGS. 18-19). The angle a may be between zero and forty degrees (0-40°) and in some configurations may be between ten and fifteen degrees, inclusive. In configurations, the angle a is about thirteen degrees (13°). It is, however, foreseen that varying requirements for external load resistance, sloped surface length, spring rates, and the like may permit use of variable values for an angle a without departing from the spirit of the present technology.

As outlined above, the corresponding sloped surface 52 may form an angle with the axis of translation AT that is substantially the same as the angle a formed by the ramped surface 100. It should be noted that rotation of the swinging bracket 62 will result in variation of the angle formed by the corresponding sloped surface 52 (due to resulting rotation of the axis of translation AT with the swinging bracket 62). However, in configurations the angle between the sloped surface 52 and the axis of translation AT be maintained within three degrees (3°) of the angle a whenever the ramped surface 100 is in latched engagement with the sloped surface 52.

During latched engagement in the stowed configuration, bumps or turbulence transmitted through the watercraft may tend to vibrate or force an end of the shaft assembly 14 opposite the motor assembly 12 upward or downward. This may apply corresponding forces to the latch pin 74 tending to slide it outward in the first direction (i.e., toward the protuberance 56 and the first end 64 of the swinging bracket 62). This movement may be opposed by frictional engagement of the ramped surface 100 with the sloped surface 52. (according to, for example, Hooke's Law). Moreover, a shallower slope of the ramped surface 100 (i.e., a smaller angle a) may increase resistance to any disengagement of the latch pin 74 from the stowed relationship. However, as outlined above, shallow angles a also tend to increase incidents of "sticking" or "jamming," making intentional disengagement from the stowed relationship more difficult or even impossible for the operator.

So that a larger angle a (e.g., in the range of the example angles outlined herein) may be employed to reduce "sticking" and "jamming" without sacrificing resistance to unintentional disengagement from a latching relationship due to environmental vibrations or bumps, the protuberance 56 is incorporated along the edge 48. Namely, the additional resistance to unintentional disengagement encountered by the latch pin 74 whenever it is forced outward into engagement with the protuberance 56 is sufficient to meet desired operational parameters in view of the environmental forces expected in normal use. The protuberance 56 may form an angle of between one hundred and sixty-five and one hundred and seventy-five degrees (165-175°) where it meets the sloped surface 52. However, one of ordinary skill will appreciate that such an angle may be decreased or increased based on manufacturing and performance requirements.

It should be noted that the above discussion regarding angle a and the angle of corresponding sloped surface 52 with respect to the axis of translation AT applies equally to the remaining latching engagement relationships of latch pins 72, 74 with edges 36, 38 and 50. Likewise, the above discussion regarding the utility of protuberance 56 in retaining a stowed configuration against bumps and turbulence and the like, as well as that of the angle(s) formed by the protuberance 56 with the sloped surface 52, each apply equally to such other latching relationships.

Returning now to FIGS. 9-17, the swinging bracket assembly 60 also includes a second swinging bracket 112 having a first end 114 and a second end 116. The first end 114 is attached to the shaft assembly 14 at a location spaced from the swinging bracket 62. (See FIG. 1) The mounting assembly 16 also includes a second pivot joint 118 comprising a pin 119 inserted through sidewalls 24, 26 to rotatably attach the second end 116 of the second swinging bracket 112 to the stationary bracket 18.

The mounting assembly 16 also includes lift assistance gas spring assemblies 120, 122. The gas spring assemblies 120, 122 may utilize air or other gas as working fluid, and therefore may also be thought of as pneumatic assemblies. The gas spring assembly 120 includes an intermediate stopping arm 123 and a hydraulic cylinder 124 comprising a rod 126 and a barrel 128. The rod 126 is received within the barrel 128 for compression of the working fluid contained in the barrel 128 when the rod 126 is retracted into the barrel 128. The barrel 128 is rotatably attached to the swinging bracket 62 opposite the rod 126 at a base mount 130 along a top surface of the swinging bracket 62. The intermediate stopping arm 123 is rotatably mounted to the pivot pin 32. The rod 126 is rotatably attached to the intermediate stopping arm 123 at rod mount 132.

Similarly, the gas spring assembly 122 includes an intermediate stopping arm 134 and a hydraulic cylinder 136 comprising a rod 138 and a barrel 140. The rod 138 is received within the barrel 140 for compression of the working fluid contained in the barrel 140 when the rod 138 is retracted into the barrel 140. The barrel 140 is rotatably attached to a bottom surface or underside of the swinging bracket 62 opposite the rod 138 at a base mount 142. The intermediate stopping arm 134 is rotatably mounted to the pivot pin 32. The rod 138 is rotatably attached to the intermediate stopping arm 134 at rod mount 144. However, the gas spring assemblies 120, 122 may present any configuration suitable for applying a desired force, including configurations lacking hydraulics, rods, and working fluids.

The gas spring assemblies 120, 122 generally rotate with the swinging bracket 62 about the pivot pin 32 as the mounting assembly 16 alternates between stowed and deployed configurations. Taking the stowed configuration and FIGS. 15-17 as examples, the swinging bracket 62 may rotate about the pivot pin 32 and advance toward a latching relationship in the stowed configuration. At a first stage in this rotation, an end of the intermediate stopping arm 134 opposite the pivot pin 32 may contact and be stopped by the bottom wall 23 of the stationary bracket 18. Subsequently, continued rotation of the swinging bracket 62 about the pivot pin 32 will cause retraction of the rod 138 into the barrel 140 of the gas spring assembly 122, causing compression of the pneumatic fluids contained therein. At a point of maximum retraction of the rod 138 into the barrel 140, the gas spring assembly 122 may prevent any further rotation of the swinging bracket 62, essentially providing a stop against corresponding movement of the latch pin 74 inward (i.e., in the second direction).

When the stowed latching relationship is subsequently released by the operator, the stored energy of the compressed fluid in the barrel 140 will assist with lifting the brackets 62, 112 from the stowed configuration and into the deployed configuration. It should also be noted that the stopping arm 123 of the gas spring assembly 120 defines a cradle 146 for receiving the shaft 17 in a stowed configuration. (See FIG. 10). However, in some configurations, the shaft 17 may omit the cradle 146.

The gas spring assembly 120 functions in a reciprocal fashion as the swinging bracket 62 rotates about the pivot pin 32 into a deployed configuration, and similarly provides an inner limit against inward movement of the latch pin 72 and lift assistance when the deployed latching relationship is released. One of ordinary skill will appreciate that a lift assistance feature may be omitted, and/or that one or more other obstructions to inward movement of latch pin(s) may be employed, within the scope of the present technology.

It should also be noted that embodiments of the present technology confine movement of the latch pins 72, 74 along at least one additional dimension. More particularly, as noted above, the slots 76, 78 confine movement of the first latch pin 72 along the axis of translation AT to a limited range. Likewise, the slots 80, 82 confine movement of the second latch pin 74 along the axis of translation AT to a limited range of corresponding size to that of the first latch pin 72. The slots 76, 78, 80, 82 are also sized so as to restrict movement of the latch pins 72, 74 along a first transverse axis perpendicular to the axis of translation AT. Further, the mounting assembly 16 may include two pairs 148, 150 of dowel rods fixed to the swinging bracket 62. (See FIG. 8) Each pair 148, 150 comprises rods spaced along the width dimension from one another. The pairs 148, 150 are themselves spaced apart along the axis of translation AT. The dowel rods of each of the pairs 148, 150 may receive the rod 88 therebetween, and thereby substantially restrict movement of the rod 88 (and, consequently, the latch pins 72, 74) along a second transverse axis perpendicular to the axis of translation AT. Collectively, therefore, the slots 76, 78, 80, 82 and pairs 148, 150 of dowel rods substantially confine movement of the latch pins 72, 74 to movement along the axis of translation AT within a limited range. It is foreseen that alternative structure for controlling inadvertent or otherwise unwanted movement of a latch pin assembly may be employed within the scope of the present technology.

Relational terms, such as "upper", "lower", "top", "bottom", "outer", "inner", etc., may be used throughout this description. These terms are used with reference to embodiments of the technology and the orientations thereof shown in the accompanying figures. Embodiments of the technology may be oriented in ways other than those shown in the figures. Therefore, the terms do not limit the scope of the present technology.

Although the technology has been described with reference to the embodiments illustrated in the attached drawing figures, it is noted that equivalents may be employed and substitutions made herein without departing from the scope of the technology. The drawing figures do not limit the present technology to the specific embodiments disclosed and described herein.

What is claimed is:

1. A trolling motor for attachment to a watercraft, the trolling motor comprising:

a motor assembly;

a shaft assembly attached to the motor assembly; and a mounting assembly configured for attachment to the watercraft, the mounting assembly including— a pivot joint configured to be fixed relative to the watercraft, a swinging bracket assembly including: (a) a swinging bracket having a first end, a second end and a length, the first end being attached to the shaft assembly and the second end being rotatably attached to the pivot joint, and (b) a latch pin assembly including an elastic element and a latch pin mounted to the swinging bracket, a stationary bracket configured to be fixed relative to the watercraft and including a protuberance and a sloped surface receiving the latch pin, wherein— the elastic element is coupled to the latch pin, the latch pin is mounted to be slidable in a first direction along a portion of the length of the swinging bracket to generate an opposing elastic force in the elastic element in a second direction opposite the first direction, the latch pin includes a ramped surface pressed against the sloped surface of the stationary bracket by the opposing elastic force in a sliding, latched relationship, the protuberance is positioned along an end of the sloped surface to obstruct sliding movement of the latch pin beyond the sloped surface to maintain the latched relationship with the sloped surface.

2. The trolling motor of claim 1, wherein the first direction and the second direction define an axis of translation for the latch pin generally along the swinging bracket, the ramped surface forms an acute latch pin angle with respect to the axis of translation, and the sloped surface of the stationary bracket forms a sloped surface angle with respect to the axis of translation that is within three degrees (3°) of the acute latch pin angle while the latched relationship is maintained.

3. The trolling motor of claim 2, wherein the acute latch pin angle is between ten degrees and fifteen degrees (10-15°), inclusive.

4. The trolling motor of claim 1, wherein the shaft assembly includes a shaft and a steering assembly, the shaft being rotatably attached to the mounting assembly via the steering assembly.

5. The trolling motor of claim 1, wherein the pivot joint comprises a pin, a portion of the stationary bracket defines a pin hole, the swinging bracket defines a corresponding pin hole along the second end, and the pin extends through the pin hole and the corresponding pin hole for rotatable attachment of the swinging bracket to the stationary bracket.

6. The trolling motor of claim 1, wherein the elastic element comprises a tension spring coupled to the latch pin via a rod.

7. The trolling motor of claim 6, wherein— the latch pin assembly includes a second latch pin mounted to the swinging bracket, the second latch pin being coupled to the elastic element via the rod, slidable in the first direction in correspondence with the latch pin, and subjected to the opposing elastic force in the second direction, the stationary bracket includes a second protuberance and a second sloped surface configured to receive the second latch pin, the second sloped surface opening in a generally opposite direction from the sloped surface, the second latch pin includes a second ramped surface configured to be pressed against the second sloped surface by the opposing elastic force in a second sliding, latched relationship, the second protuberance is positioned along an end of the second sloped surface to obstruct sliding movement of the second latch pin beyond the second sloped surface to maintain the second latched relationship with the second sloped surface, the latched relationship and the second latched relationship respectively correspond to stowed and deployed configurations of the trolling motor.

8. The trolling motor of claim 6, wherein— the first direction and the second direction define an axis of translation along the swinging bracket for the latch pin, the swinging bracket defines a slot extending along the axis of translation substantially restricting movement of the latch pin along a first transverse axis perpendicular to the axis of translation, the swinging bracket assembly includes a first pair of spaced dowel rods extending along the first transverse axis, and a second pair of spaced dowel rods extending along the first transverse axis and spaced from the first pair of dowel rods along the length of the swinging bracket, the rod extends through the first and second pairs of dowel rods, the first and second pairs of dowel rods substantially restricting movement of the rod along a second transverse axis perpendicular to the axis of translation.

9. The trolling motor of claim 6, wherein the latch pin assembly includes a pull string attached to the rod.

10. The trolling motor of claim 1, wherein the swinging bracket assembly further comprises a second swinging bracket having a first end and a second end, the first end of the second swinging bracket being attached to the shaft assembly at a location spaced from the swinging bracket, and the second end of the second swinging bracket being rotatably attached to a second pivot joint of the mounting assembly.

11. The trolling motor of claim 10, further comprising a first lift-assistance gas spring assembly attached to an underside of the swinging bracket, and a second lift-assistance gas spring assembly attached to a top side of the swinging bracket.

12. A mounting assembly for a watercraft trolling motor including a shaft assembly, the mounting assembly comprising:

a pivot joint configured to be fixed relative to the watercraft, a swinging bracket assembly including: (a) a swinging bracket having a first end, a second end and a length, the first end being configured for attachment to the shaft assembly and the second end being rotatably attached to the pivot joint, and (b) a latch pin assembly including an elastic element and a latch pin mounted to the swinging bracket, a stationary bracket configured to be fixed relative to the watercraft and including a protuberance and a sloped surface receiving the latch pin, wherein— the elastic element is coupled to the latch pin, the latch pin is mounted to be slidable in a first direction along a portion of the length of the swinging bracket to generate an opposing elastic force in the elastic element in a second direction opposite the first direction, the latch pin includes a ramped surface pressed against the sloped surface of the stationary bracket by the opposing elastic force in a sliding, latched relationship, the protuberance is positioned along an end of the sloped surface to obstruct sliding movement of the latch pin beyond the sloped surface to maintain the latched relationship with the sloped surface.

13. The mounting assembly of claim 12, wherein the first direction and the second direction define an axis of translation for the latch pin generally along the swinging bracket, the ramped surface forms an acute latch pin angle with respect to the axis of translation, and the sloped surface of the stationary bracket forms a sloped surface angle with respect to the axis of translation that is within three degrees (3°) of the acute latch pin angle while the latched relationship is maintained.

14. The mounting assembly of claim 13, wherein the acute latch pin angle is between ten degrees and fifteen degrees (10-15°), inclusive.

15. The mounting assembly of claim 12, wherein the pivot joint comprises a pin, a portion of the stationary bracket defines a pin hole, the swinging bracket defines a corresponding pin hole along the second end, and the pin extends through the pin hole and the corresponding pin hole for rotatable attachment of the swinging bracket to the stationary bracket.

16. The mounting assembly of claim 12, wherein the elastic element comprises a tension spring coupled to the latch pin via a rod.

17. The mounting assembly of claim 16, wherein— the latch pin assembly includes a second latch pin mounted to the swinging bracket, the second latch pin being coupled to the elastic element via the rod, slidable in the first direction in correspondence with the latch pin, and subjected to the opposing elastic force in the second direction, the stationary bracket includes a second protuberance and a second sloped surface configured for receiving the second latch pin, the second sloped surface opening in a generally opposite direction from the sloped surface, the second latch pin includes a second ramped surface configured to be pressed against the second sloped surface by the opposing elastic force in a second sliding, latched relationship, the second protuberance is positioned along an end of the second sloped surface to obstruct sliding movement of the second latch pin beyond the second sloped surface to maintain the second latched relationship with the second sloped surface, the latched relationship and the second latched relationship respectively correspond to stowed and deployed configurations of the trolling motor.

18. The mounting assembly of claim 16, wherein— the first direction and the second direction define an axis of translation along the swinging bracket for the latch pin, the swinging bracket defines a slot extending along the axis of translation substantially restricting movement of the latch pin along a first transverse axis perpendicular to the axis of translation, the swinging bracket assembly includes a first pair of spaced dowel rods extending along the first transverse axis, and a second pair of spaced dowel rods extending along the first transverse axis and spaced from the first pair of dowel rods along the length of the swinging bracket, the rod extends through the first and second pairs of dowel rods, the first and second pairs of dowel rods substantially restricting movement of the rod along a second transverse axis perpendicular to the axis of translation.

19. The mounting assembly of claim 12, wherein the swinging bracket assembly further comprises a second swinging bracket having a first end and a second end, the first end of the second swinging bracket being configured for attachment to the shaft assembly at a location spaced from the swinging bracket, and the second end of the second swinging bracket being rotatably attached to a second pivot joint of the mounting assembly.

20. The mounting assembly of claim 19, further comprising a first lift-assistance gas spring assembly attached to an underside of the swinging bracket, and a second lift-assistance gas spring assembly attached to a top side of the swinging bracket.

* * * * *